US005909876A

United States Patent [19]

Brown

[11] Patent Number: 5,909,876

[45] Date of Patent: Jun. 8, 1999

[54] GAME MACHINE WAGER SENSOR

[75] Inventor: J. Breck Brown, Las Vegas, Nev.

[73] Assignee: Steven R. Pyykkonen, Leonard, Mich.; a part interest

[21] Appl. No.: 09/050,687

[22] Filed: Mar. 30, 1998

[51] Int. Cl.[6] ..... A63F 1/18; A63F 1/06

[52] U.S. Cl. ..... 273/309; 463/29

[58] Field of Search ..... 434/128, 129; 273/274, 292, 309; 463/25, 26, 27, 29

[56] References Cited

U.S. PATENT DOCUMENTS

| | | | |
|---|---|---|---|
| 3,819,186 | 6/1974 | Hinterstocker . | |
| 4,838,557 | 6/1989 | Floyhar . | |
| 5,364,104 | 11/1994 | Jones et al. . | |
| 5,377,994 | 1/1995 | Jones . | |
| 5,393,067 | 2/1995 | Paulsen et al. . | |
| 5,536,016 | 7/1996 | Thompson . | |
| 5,573,248 | 11/1996 | Parra et al. . | |
| 5,669,816 | 9/1997 | Garczynsk | 463/12 |
| 5,722,893 | 3/1998 | Hill | 463/47 |
| 5,735,525 | 4/1998 | McCrea | 273/309 |
| 5,782,472 | 7/1998 | Brown | 273/309 X |
| 5,823,875 | 10/1998 | Tarantino | 273/309 X |
| 5,836,818 | 11/1998 | Jones | 463/29 |

*Primary Examiner*—Richard J. Apley
*Assistant Examiner*—William LaMarca
*Attorney, Agent, or Firm*—Howard & Howard

[57] ABSTRACT

A game board for playing a game upon which wagers are made. The board comprises an upper playing surface (12) presenting a plurality of player areas with each of the player areas including at least one wager indicator (20, 22, 24). Each wager indicator (20, 22, 24) is characterized by including a lens (27) substantially flush with the playing surface (12) and a sensor (28) for sensing the presence of a chip on the lens (27). The sensor (28) comprises a photocell under the lens (27) and in the center thereof for sensing the presence of a chip on the lens (27). The lens (27) is circular and a light (30), comprising a plurality of light emitting diodes in a circular tube, is disposed about the circumference of the lens (27) and around the sensor (28). A register (34) accumulates the wagers on each indicator (20, 22, 24) and a switching device (36) maintains the light (30) for each indicator (20, 22, 24) illuminated after a chip is removed from the lens (27).A light shield (54) is disposed between the sensor (28) and thelight for preventing light rays from the light from reaching the sensor (28).

15 Claims, 4 Drawing Sheets

GAME MACHINE WAGER SENSOR

TECHNICAL FIELD

The subject invention relates to a game in which a wager is made by placing a chip on the surface of a game board, such as a table.

BACKGROUND OF THE INVENTION

There are various card games in which a wager is placed on the table by placing one or more chips on a designated spot on the gaming surface. There are various games in which a coin or chip is inserted into a slot and the wager is indicated by a light. Such systems are shown in the U.S. Pat. Nos. 3,819,186 to Hinterstocker; 4,838,557 to Floyhar; 5,536,016 to Thompson; 5,364,104 to Jones et al, 5,377,994 to Jones, 5,393,067 to Paulsen et al, and 5,573,249 to Johnson. In some games it is often desirable to remove the chips after the bet is made. In other words, it is often desirable for a player to place a bet, yet allow a dealer to remove the chips from the betting area while the bet remains in force during play.

SUMMARY OF THE INVENTION AND ADVANTAGES

A game board for playing a game upon which wagers are made. The board has an upper playing surface presenting a plurality of player areas with each player area including at least one wager indicator. The wager indicator is characterized by including a lens substantially flush with the playing surface and a sensor for sensing the presence of a chip on the lens. The sensor comprises a photo-cell under each of the lens and in the center thereof for sensing the presence of a chip on the lens and a light surrounds each of the sensors for indicating that a wager has been placed on the lens of the wager indicator. A light shield is disposed between the photo-cell and the light for preventing light rays from the light from reaching photo-cell.

DESCRIPTION OF THE DRAWINGS

Other advantages of the present invention win be readily appreciated as the same becomes better understood by reference to the following detailed description when considered in connection with the accompanying drawings wherein.

DETAILED DESCRIPTION OF THE PREFERRED EMBODIMENT

Figure 1:
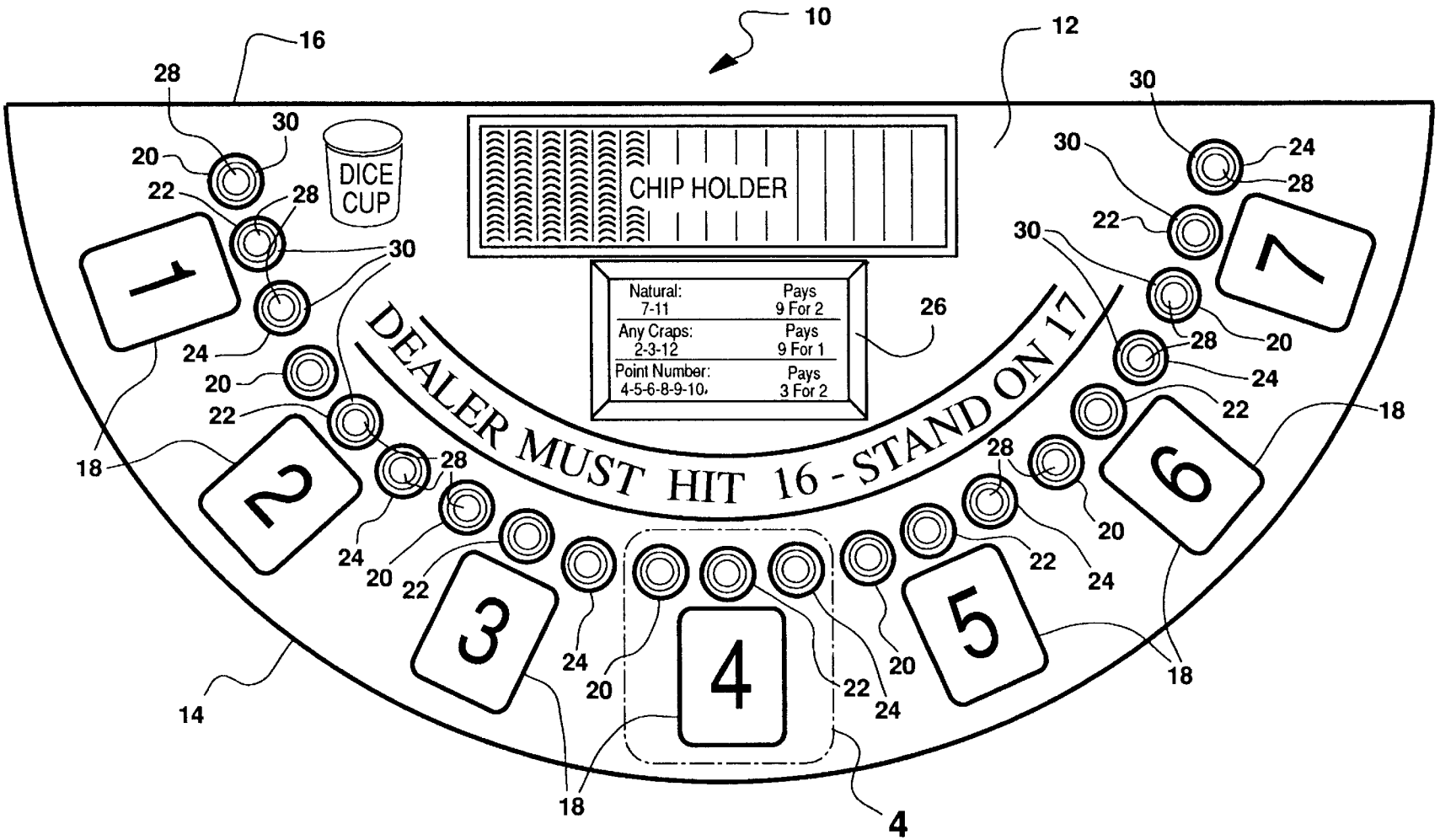
FIG. 1 is a plan view of a table top or game board implementing the subject invention.
Figure 2:
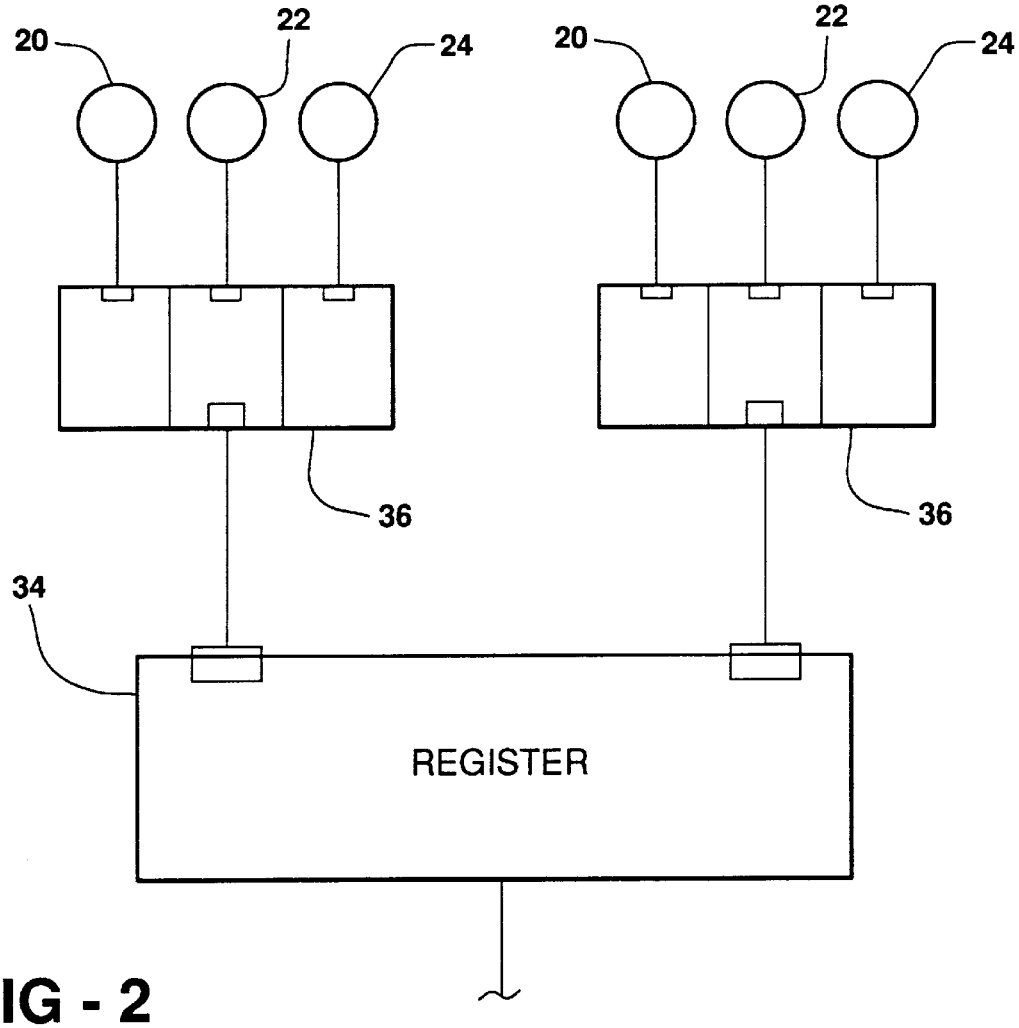
FIG. 2 is a schematic view of the subject invention.
Figure 3:
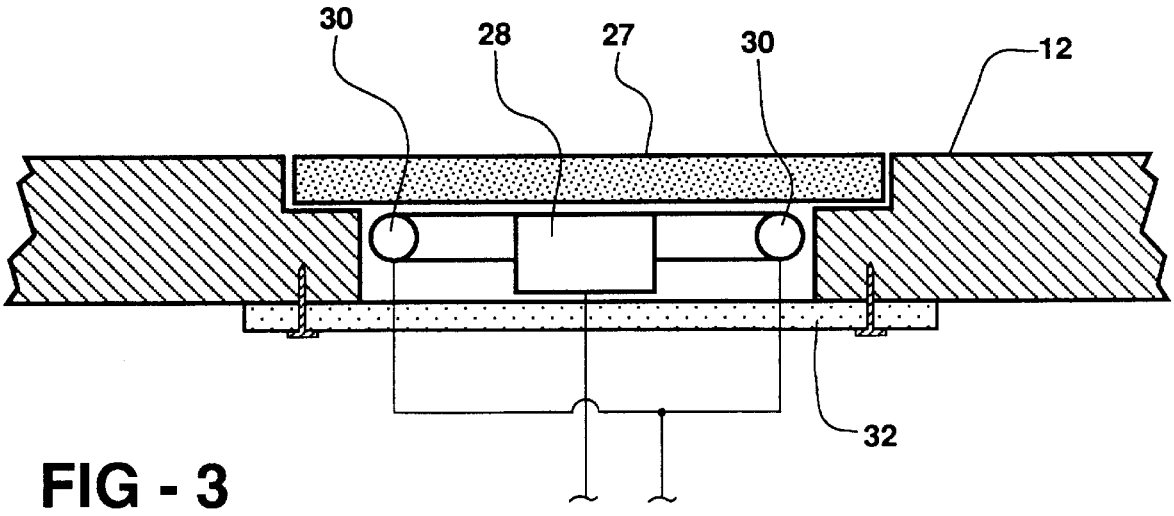
FIG. 3 is an enlarged fragmentary view taken along line 3—3 of FIG. 1.

Referring to the Figures, wherein like numerals indicate like or corresponding parts throughout the several views, an amusement device for combining the play of twenty-one and craps is generally shown in FIG. 1. The device takes the form of a game board, mat, table cloth or cover, place mat, or the like, and may even be implemented in a computer program producing images for a monitor. In any case the device comprises a presenter for positioning at least two cards for each player and a craps wager indicator for each player to indicate the craps wager based upon the roll of two dice by each player having only two cards equaling twenty-one.

As illustrated, the device is a game board generally indicated at 10 for combining the play of twenty-one based upon at least one card deck having fifty-two cards divided into four suites of duces through aces and the play of craps based upon two dice each having six faces numbered one to six. The board 10 comprises an upper playing surface 12 which presents a semicircular playing arena, defined by the semi-circular periphery 14 and the straight diameter 16. A dealer playing area is disposed adjacent the straight diameter 16 of the semicircular playing arena. More specifically, the dealer playing area is in the area between the indicia portraying the chip holder and chips and the indicia indicating that the dealer must stand on a card count of 17 and take a card on a card count of 16. This is a dealer presentation area for presenting the dealer's cards.

The board also defines a plurality of player areas spaced about the circumference of the circular periphery 14 of the semi-circular playing arena and opposed to the dealer playing area. Each of the player areas comprises a rectangular card box 18 defining a player presentation area for each player to present the player cards. A plurality of craps wager indicators 20, 22 and 24 are disposed adjacent each player card rectangle 18 to divide the numbers 2 through 12 into a plurality of groups for wagering at different odds for each group. More specifically, a plurality of three craps wager indicators 20, 22 and 24 are presented for each player with each indicator presenting different odds for different total dice numbers. A first 20 of die indicators presents the numerals 7 and 11 for first odds of five for one, a second 22 of the indicators presents the numerals 2, 3 and 12 for second odds of nine for one, and a third 24 of the indicators presents the remaining numbers for third odds of three for two.

The game board 10 presents an odds area 26 centrally located and indicating the first, second and third odds for the respective wager areas 20, 22 and 24. That is, the table pay-off odds of five chips for one chip bet on a natural 7 or 11, the second table pay-off odds of nine chips for one chip bet on craps 2, 3 or 12, and the third table pay-off odds of three chips for two chips bet on the point numbers 4, 5, 6, 8, 9 or 10. The first true odds are three and one half to one for a natural 7 or 11, the second true odds are eight to one for craps 2, 3 or 12, and the third true odds are one to two for point numbers 4, 5, 6, 8, 9 or 10.

The invention, therefore, includes a method of combining the play of twenty-one and craps comprising the basic steps of presenting at least two cards to each player followed by then offering a craps wager based upon the roll of two dice to a player having two cards equaling twenty-one, i.e., to each player having a blackjack. Each player having blackjack and beating the dealer then places a craps wager and rolls the dice; the wagers are then settled based upon the outcome of the roll of the dice. The offering of the craps wager includes the offer of a plurality of alternative dice number combinations in groups having different betting odds. More specifically, the offering of the wager combinations are divided into the dice number combinations of the natural 7 or 11 at first odds, the dice number combinations of any craps 2, 3 or 12 at second odds, and the remaining dice number combinations of the point numbers 4, 5, 6, 8, 9, or 10 at different third odds. For example, the numerals 7 and 11 may be at first odds of nine for two, the numerals 2, 3 and 12 may be at second odds of nine for one, and the remaining numbers of 4, 5, 6, 8, 9, and 10 may be at third odds of three for two. Of course, these odds may vary as in accordance with individual house rules.

The play of twenty-one is based upon at least one card deck having fifty-two cards divided into four suites of duces through aces and the play of craps based upon two dice each having six faces numbered one to six. It involves the placing of a blackjack wager on behalf of each player to beat a dealer player by placing chips in front of the card boxes 18. The dealer, or machine, presents two cards to each player including the dealer player by placing the cards on the card boxes 18 in sequence about the semi-circle 14. As is normal in the game of blackjack, additional cards are sequentially presented to each player in response to a request for same from that player. Thereafter, the blackjack wagers are paid or settled in the absence of requests for additional cards. The opportunity or option to roll two dice is then presented to each player beating the dealer player with a blackjack consisting of only two cards equaling twenty-one. However, before the roll of the dice, each player establishes a craps wager, if the player wishes to participate, based upon the roll of the two dice by placing chips on one of the three circles 20, 22, or 24 to indicate the numbers and odds of the roll. The blackjack winner then rolls the dice once and each craps wager is settled based the outcome of the roll of the dice.

Accordingly, at one seating a player may play blackjack and qualify to further bet on a craps roll of the dice each time a player is dealt a blackjack.

An accumulated pot variation which may be combined with or substituted for the wager entitlement which occurs upon a player having two cards equaling twenty-one. In either case, the two are completely independent as the wagers on the accumulated pot are accumulated separately and paid out on independent criteria. However, in the preferred embodiment, the accumulated pot is played along with or in conjunction with the craps wager entitlement. More specifically, the accumulated pot variation is played by offering an accumulative pot wager based upon the roll of two dice prior to presenting the cards to the players. in other words, the entire game is initiated by each player placing a pot wager on one or more of the craps wager indicator areas 20, 22 and 24.

The invention is characterized by each wager indicator including a lens 27 substantially flush with said playing surface, i.e., the upper surface of the lens is flush enough with the upper surface 12 of the game board 10 to prevent cards from hanging up or being prevented from sliding over the lens. A sensor 28 is included for sensing the presence of a chip on the lens 27. The lens 27 is clear or opaque to allow light to pass through and the sensor 28 senses the absence of such light when a chip covers the center of the lens 27. Each sensor 28 comprises a photo-cell supported centrally under each lens 27 by a bracket 32 secured to the bottom of the table or board 12. Each wager indicator also includes a light 30 for indicating that a wager has been placed on the lens of the wager indicator. The light 30 surrounds the sensor 28 under each lens 27 and comprises at least one light emitting diode. As illustrated, each lens 27 is circular and each light 30 comprises a plurality of light emitting diodes disposed about the circumference of the circular lens 27 and around the sensor 28 in the middle of that lens. Each light 30 comprises a tube of light with a longitudinal axis disposed in circle about the circumference of the lens 27 and around the sensor 28. The diodes may be equally spaced within the tube or the tube may be of the florescent type. In addition, the lights are of a plurality of colors, e.g., each indictor may be of a different color or each indicator may include a plurality of diodes each of a different color. The numbers 7 and 11 are disposed in circle about the photo-cell and above the light of the first indicator 20, the numbers 2, 3 and 12 are disposed in circle about the photo-cell and above the light of the second indicator 22, and the numbers 4, 5, 6, 8, 9 and 10 are disposed in circle about the photo-cell and above the light of the third indicator 24.

The system will include a register 34 for storing the pot wager placed by each player upon the craps wager indicators 20, 22 and 24, i.e., the register 34 will indicate the one or ones of the three craps wager indicator areas 20, 22 and 24 upon which each player has placed a pot wager. In addition to the register 34, each wager indicator 20, 22 and 24 has a sensor 28 for electronically counting the chip wagered on the pot with an indicator light 30 to indicate the indicator upon a chip was wagered. More specifically, a switching device 36 is disposed between each group of indicators for each player and the register 34 for switching the light 30 on when the sensor 28 associated therewith senses a chip and maintains that light in the on or illuminated condition after the dealer removes the chips from the table. In other words, the switching device 36 maintains the light for each indicator illuminated after the chip is removed from the lens 30 and during the play of blackjack until play is over or a player becomes qualified by being dealt a predetermined blackjack, in which case, that qualified player rolls the dice for the accumulated pot or pots upon which the player initially placed a wager.

Figure 5:
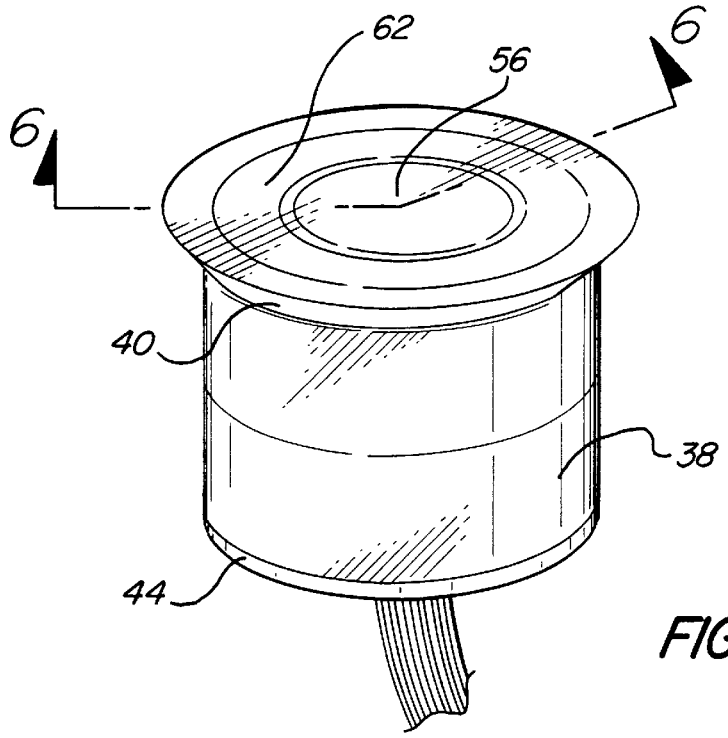
FIG. 5 is a perspective view of the indicator of the subject invention.
Figure 6:
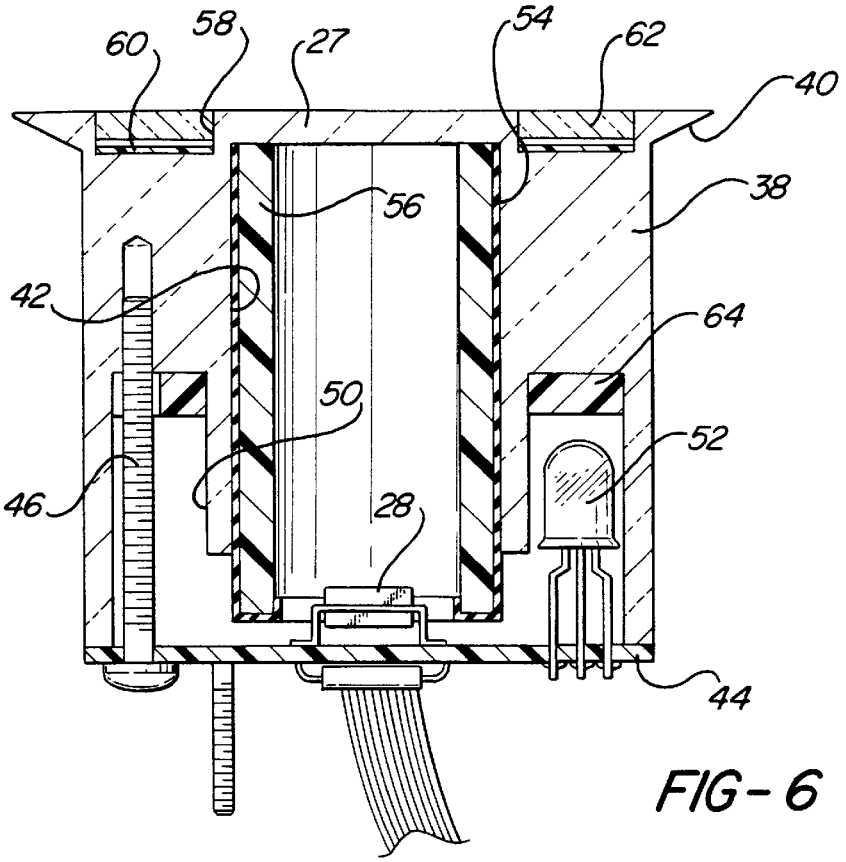
FIG. 6 is a cross sectional view taken substantially along line 6—6 of FIG. 5.

As illustrated in FIGS. 5 and 6, each of the indicators 20, 22 and 24 has a cylindrical body 38 with the lens 27 at an upper end thereof and presenting an open lower end. The lens 27 has an annular periphery extending radially outwardly from the cylindrical body 38 and is tapered or conical 40 to engage a beveled countersunk hole in the playing surface 12.

The cylindrical body 38 has a central cavity 42 extending from the open bottom to the lens 27. A circuit board 44 is secured to the bottom of the cylindrical body 38 by threaded fasteners 46 which extend through the circuit board 44 and are threaded into the cylindrical body 38 for securing the circuit board 44 to the body 38. The photo-cell 28 is disposed on the circuit board 44 and is axially aligned with the central cavity 42. The body 38 includes a depending skirt 48 to define the lower end of the cavity 42 and to define an annular space 50 in the open bottom of the body 38.

The light 30 comprises a plurality of LED lights 52 supported about a circle on the circuit board 44 and extending into the annular space 50 in the open bottom of the cylindrical body 38.

A light shield 54 is disposed in the cavity 42 around the photo-cell 28 and between the photo-cell 28 and the light for preventing light rays from the light from reaching the photo-cell 28. The shield 54 is tubular with an upper end adjacent the lens 27 and a lower end adjacent and surrounding the photo-cell 28. The shield 54 comprises a light impervious layer supported on and around a plastic tube 56, both of which are press fit into the central cavity 42.

Figure 4:
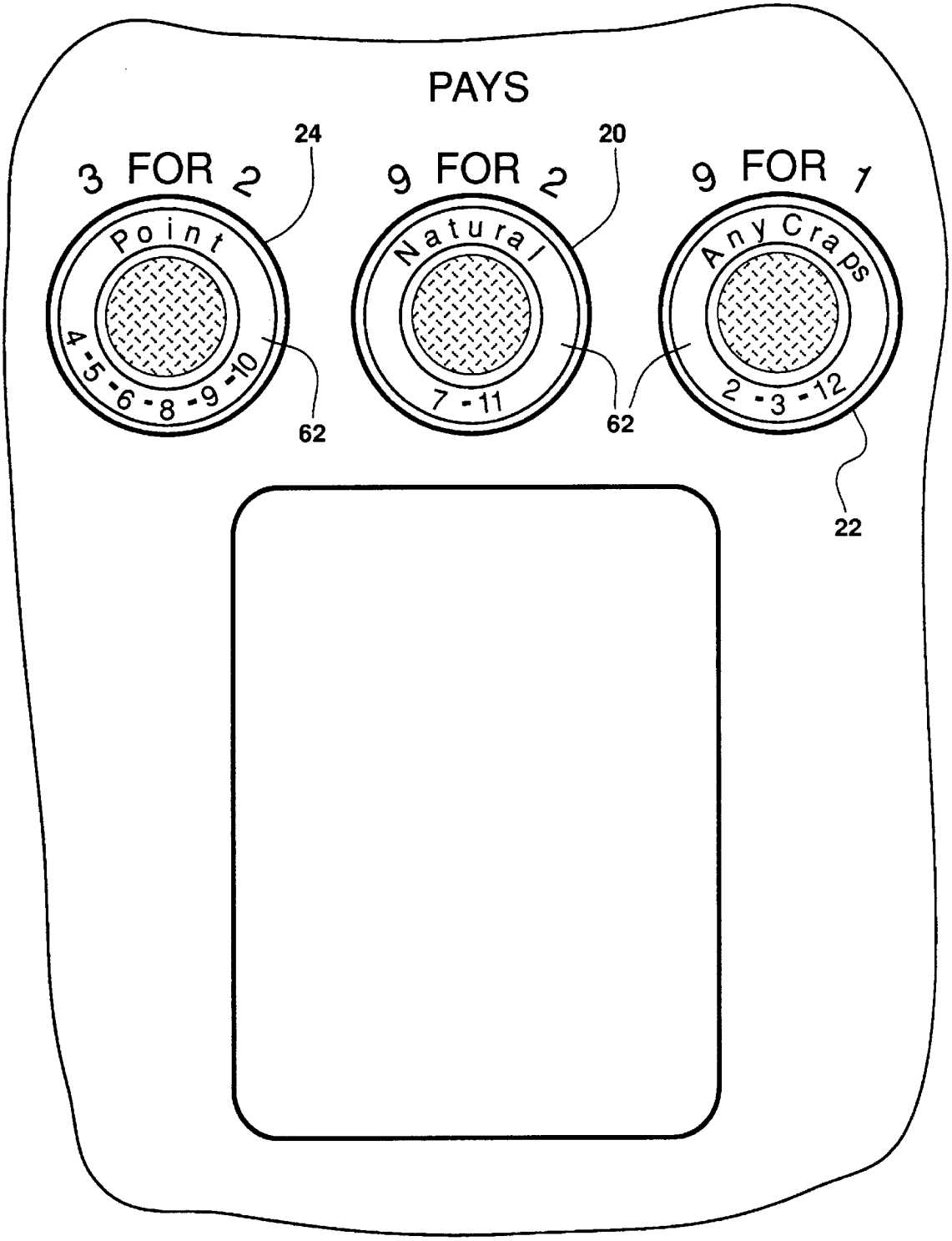
FIG. 4 is a fragmentary plan view of one player area.

The lens 27 presents an annular recess 58. A wafer 60 with indicia thereon is disposed in the recess 58 and an opaque ring 62 fills the recess 58 over or above the wafer 60 whereby the indicia on the wafer 60 is visible through the wafer 60. More specifically and as best shown in FIG. 4, a first of the wafers 60 for the first 20 of the indicators for each player area presents the numbers 7 and an 11 for first odds, a second of the wafers 60 for a second 22 of the indicators for each player area presents the numbers 2, 3 and 12 for second odds, and a third of the wafers 60 for a third 24 of the indicators for each player area presents the numbers 4, 5, 6, 8, 9 and 10 for third odds. The numbers 7 and 11 are disposed in circle about the lens of the first indicator 20, the numbers 2, 3 and 12 are disposed in circle about the lens of the second indicator 22, and the numbers 4, 5, 6, 8, 9 and 10 are disposed in circle about the lens of the third indicator 24. The numbers 7 and 11 are disposed vertically above the lights 52 of the first indicator 20, the numbers 2, 3 and 12 are disposed vertically above the lights 52 of the second indicator 22, and the numbers 4, 5, 6, 8, 9 and 10 are disposed vertically above the lights 52 of the third indicator 24.

Further to enhance the assembly, a light dispersion ring 64 is disposed in the annular space 50. around the skirt 50 and around the light shield 54 and above the light and vertically below the opaque ring 62 for dispersing light around the opaque ring 62. In other words, the dispersion ring 64 evens the light around the opaque ring 62 to provide an evenly lite opaque ring 62.

Accordingly, the light shield 54 prevents light from reaching the photo-cell 28 when a chip or coin is disposed on the lens 27, i.e., the photo-cell produces a signal when light is cut off from the photo-cell, which then indicates that a wager has been made by illuminating the lights.

The game proceeds as described above with the craps wager indicator areas 20, 22 and 24 used by the players to place wagers in the event one of the players gets twenty-one. Successive hands are dealt and played while accumulating the pot wagers without payout until a player becomes a qualified player by having two cards of a predetermined combination to make a predetermined blackjack equaling twenty-one. In other words, when a player receives a predetermined blackjack, e.g., a predetermined combination of an Ace and a Jack of the same suit or different suits, or specifically the Ace of hearts and the Jack of spades, that player becomes a qualified player eligible to win a portion of the accumulated pot. The register 34 has retained the count as to which indicators each player has placed an accumulated pot wager; thus, accumulating the total in each accumulated pot from hand to hand. The lights 30 and 52 indicate the wagers and allow the qualified player with the predetermined blackjack to roll the dice for that particular accumulated pot.

The qualified player rolls the dice to match his initial pot wager placed at the beginning of the game and which the register light 30 has indicated throughout the play. If the player placed wagers on more than one indicator, the player rolls the dice once for each different indicator upon which the player placed a wager. Accordingly, an or at least a portion of the accumulated pot is paid out to the qualified player in response to the registered pot wager by the qualified player covering the outcome of the roll of the dice. That is, the accumulated pot is paid to the player if the roll of the dice for a certain indicator matches any of the numbers in that indicator. The accumulated pot is divided into three different payout portions each corresponding to one of the craps wager indicators 20, 22 and 24. Hence, the pot wager is made on the dice number combinations of 2, 3 and 12 at the greatest payout portion and dice number combinations of 7 and 11 at a lesser payout portion and the remaining dice number combinations at the smallest payout portion.

Although the invention has been described in connection with a game combining craps and blackjack, it may be used effectively with any card game where wagers are placed upon a table, e.g., poker, baccarat, and the like.

The invention has been described in an illustrative manner, and it is to be understood that the terminology which has been used is intended to be in the nature of words of description rather than of limitation. Obviously, many modifications and variations of the present invention are possible in light of the above teachings. It is, therefore, to be understood that within the scope of the appended claims, wherein reference numerals are merely for convenience and are not to be in any way limiting the invention may be practiced otherwise than as specifically described.

What is claimed is:

1. A game board for playing a game upon which wagers are made, said board comprising:

an upper playing surface (12) presenting a plurality of player areas, each of said player areas including first, second and third wager indicators (20,22,24), each of said wager indicators (20,22,24) including lens (27) substantially flush with said playing surface (12) sensor (28) for sensing the presence of a chip on said lens (27), said sensor comprising a photo-cell under each said lens (27) and in the center thereof for sensing the presence of a chip on said lens (27), and a light (30) surrounding each of said sensors for indicating that a wager has been placed on said lens of said wager indicator (20,22,24), and a light shield (54) having a lower end adjacent said photo cell and a upper end adjacent said lens for preventing light rays from said light from reaching said photo-cell.

2. A game board as set forth in claim 1 wherein said shield (54) is cylindrical.

3. A game board as set forth in claim 1 wherein said lens presents an annular recess (58), a wafer (60) with indicia thereon disposed in said recess (58), and an opaque ring (62) filling said recess (58) over said wafer (60) whereby the indicia on said wafer (60) is visible through said wafer (60).

4. A game board as set forth in claim 3 wherein a first of said wafers (60) for said first (20) of said indicators for each player area presents the numbers 7 and an 11 for first odds, a second of said wafers (60) for a second (22) of said indicators for each player area presents the numbers 2, 3 and 12 for second odds, and a third of said wafers (60) for a third (24) of said indicators for each player area presents the numbers 4, 5, 6, 8, 9 and 10 for third odds.

5. A game board as set forth in claim 1 wherein each of said indicators has a cylindrical body (38) with said lens at an upper end thereof and presenting an open lower end.

6. A game board as set forth in claim 5 said lens having an annular periphery extending radially outwardly from said cylindrical body (38).

7. A game board as set forth in claim 6 wherein said periphery of said lens is tapered (40) to engage a beveled countersunk hole in said playing surface.

8. A game board as set forth in claim 5 including a circuit board (44) secured to said bottom of said cylindrical body (38).

9. A game board as set forth in claim 8 wherein said light comprises a plurality of lights (52) supported about a circle on said circuit board (44) and extending into said open bottom of said cylindrical body (38).

10. A game board as set forth in claim 9 wherein said cylindrical body (38) has a central cavity (42) extending from said open bottom to said lens, said photo-cell being disposed on said circuit board (44) axially aligned with said central cavity (42), light shield (54) disposed in said cavity (42) around said photo-cell and between said photo-cell and said light for preventing light rays from said light from reaching said photo-cell.

11. A game board as set forth in claim 10 wherein said shield (54) comprises a light impervious layer and a tube surrounded by said light impervious layer.

12. A game board as set forth in claim 10 including fasteners (46) extending through said circuit board (44) and into said cylindrical body (38) for securing said circuit board (44) to said body (38).

13. A game board as set forth in claim 10 wherein said lens presents an annular recess (58), a wafer (60) with indicia thereon disposed in said recess (58), and an opaque ring (62) filling said recess (58) over said wafer (60) whereby the indicia on said wafer (60) is visible through said wafer (60).

14. A game board as set forth in claim 13 including a light dispersion ring (64) disposed around said light shield (54) and above said light and below said opaque ring (62) for dispersing light around said opaque ring (62).

15. A game board (44) as set forth in claim 14 wherein said body (38) includes a depending skirt (48) to define the lower end of said cavity (42) and to define an annular space (50) in the open bottom of said body (38), said light dispersion ring (64) being disposed in said annular space (50).

* * * * *